US005908439A

United States Patent [19]

Ford et al.

[11] Patent Number: 5,908,439

[45] Date of Patent: Jun. 1, 1999

[54] CHILD'S PACIFIER WITH NIPPLE BASE SECURED BETWEEN A FABRIC COVERING AND AN ELONGATED MEMBER

[76] Inventors: Andrea S. Ford; Lawrence L. Vineyard, Jr., both of 1411 Rambler Rd., Arlington, Tex. 76014

[21] Appl. No.: 08/796,633

[22] Filed: Feb. 7, 1997

[51] Int. Cl.[6] ..... A61J 17/00

[52] U.S. Cl. ..... 606/234

[58] Field of Search ..... 606/234–235, 606/236

[56] References Cited

U.S. PATENT DOCUMENTS

| | | | |
|---|---|---|---|
| 5,263,975 | 11/1993 | La Rocca | 606/234 |
| 5,487,750 | 1/1996 | Burchett et al. | 606/236 |
| 5,522,849 | 6/1996 | Xiques et al. | 606/236 |
| 5,534,014 | 7/1996 | Demeritt et al. | 606/236 |
| 5,593,336 | 1/1997 | Thomas | 446/81 |
| 5,665,113 | 9/1997 | Decker et al. | 606/234 |

*Primary Examiner*—Michael Buiz
*Assistant Examiner*—Vikki Trinh
*Attorney, Agent, or Firm*—Felsman, Bradley, Gunter & Dillon LLP; Dan Venglarik

[57] ABSTRACT

A child's pacifier comprises an elongated member having a nipple portion protruding from a peripheral surface proximate to one end. The elongated member includes a flexible body having an oblong cross-section and a cloth covering wrapped around the flexible body. The nipple portion of a standard baby bottle nipple protrudes through a hole in the cloth covering.

9 Claims, 2 Drawing Sheets

CHILD'S PACIFIER WITH NIPPLE BASE SECURED BETWEEN A FABRIC COVERING AND AN ELONGATED MEMBER

BACKGROUND OF THE INVENTION

1. Technical Field

The present invention relates generally to a child's pacifier and in particular to a child's pacifier adapted for promoting the child's fine motor skills at an early age. Still more particularly, the present invention relates to a child's pacifier designed to be easily retrievable by the child and to promote the child's fine motor skills by such retrieval.

2. Description of the Related Art

Children's pacifiers have long been used to sooth crying children, particularly infants and toddlers, and to provide the child with an alternative activity to crying. Contemporary children's pacifiers are also designed to promote the child's development. On example is orthodontic pacifiers, which are designed to provide the child with an oral exercise, thereby promoting healthy dental development.

An inevitable—and typically frequent—occurrence attending use of a pacifier is loss of the pacifier by the child. Conventional children's pacifiers are generally unsuitable for retrieval by the child unless the child has already achieved a level of development, including development of fine motor skills, which is inconsistent with the need for having a pacifier. Simply stated, by the time a child is capable of retrieving a lost pacifier by itself, the child is normally old enough to no longer need a pacifier. Typically it is the small size of conventional pacifiers which precludes self-retrieval by the child. Thus, at a minimum, loss of a conventional pacifier by the child requires the child's caregiver to retrieve the pacifier for the child.

Self-retrieval of a lost pacifier by the child is of particular importance for premature infants which must be kept in an incubator or other protective enclosure. While the enclosure usually includes portals allowing a caregiver to reach inside and retrieve the pacifier for the child, intrusions into the enclosure are undesirable due to the dangers of biological or bacterial contamination.

A secondary effect of a child losing a conventional pacifier is that such loss may go unnoticed by the child's caregiver, resulting in failure to retrieve the pacifier. For this reason, experienced caregivers will normally keep several pacifiers on hand and periodically replenish their stock as pacifiers are lost. Prior art solutions to this problem have generally been directed attaching the pacifier to the child in some manner, whether by a string around the child's neck or to a fastener attached to the child's clothing, or by employing a bib designed to retain the pacifier. In addition to the obvious disadvantages of such attachments, particularly employing strings around an infant's neck, these solutions do nothing to facilitate self-retrieval of the pacifier by the child.

Studies indicate that the United States is experiencing a baby-boom echo, a trend of increased birth rates as women born in 1957 and 1958 (the peak years of the post-war baby boom) approach the end of their child bearing years. Simultaneously, the average age of primary caregivers has increased an the manner in which children are cared for has changed, particularly in the area of daycare where each caregiver is responsible for attending a larger number of children. Therefore it is increasingly important to promote development in the child as early as possible.

It would be desirable, therefore, for a child's pacifier to facilitate self-retrieval by the child. It would further be desirable for such a pacifier to simultaneously promote development of fine motor skills in the child, such as grasping, manipulating, and carrying objects, locating particular portions of objects, and shifting objects from one hand to the other. It would advantageous if such a pacifier could be easily constructed from readily available materials without special manufacturing and were easy to maintain.

SUMMARY OF THE INVENTION

A child's pacifier comprises an elongated member having a nipple portion protruding from a peripheral surface proximate to one end. The elongated member includes a flexible body having an oblong cross-section and a cloth covering wrapped around the flexible body. The nipple portion of a standard baby bottle nipple protrudes through a hole in the cloth covering.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION

Figure 1C:
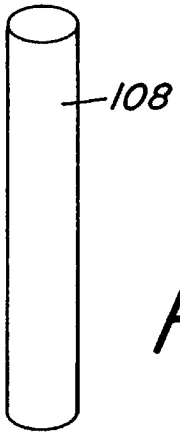
FIGS. 1A–1C depict components of a child's pacifier in accordance with a preferred embodiment of the present invention.
Figure 1A:
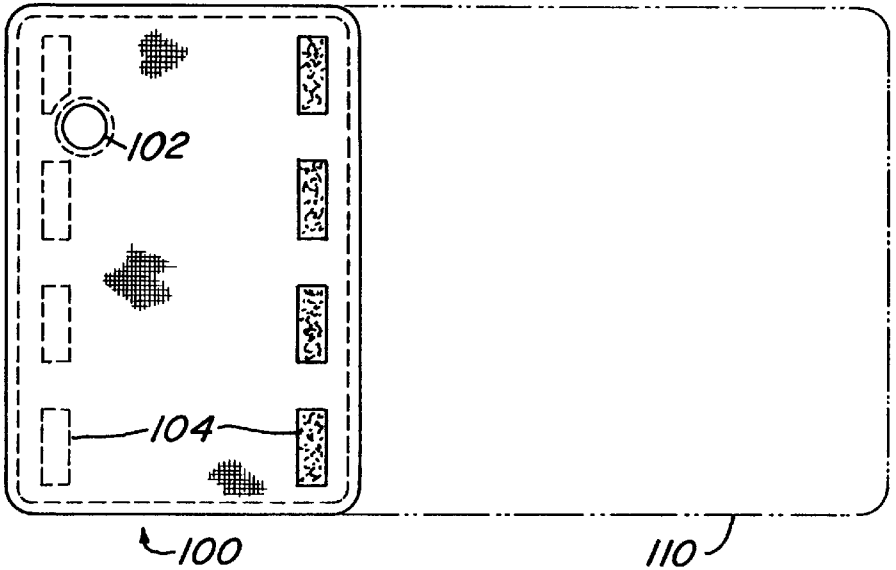
Figure 1B:
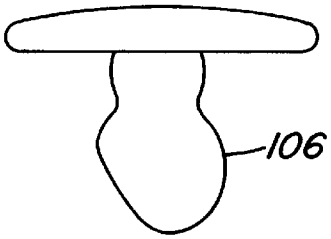

With reference now to the figures, and in particular with reference to FIGS. 1A–1C, components of a child's pacifier are depicted in accordance with a preferred embodiment of the present invention. The components depicted are not drawn to scale, but are shown in such a manner as to best illustrate the features of the invention.

The child's pacifier includes a cloth portion 100. Cloth portion 100 is preferably a soft material to appeal to the child. Cloth portion 100 includes a hole 102 near an edge, preferably near a corner. Hole 102 is sized to receive a nipple and preferably is appropriately reinforced. Cloth portion 100 may also include fasteners 104 suitably affixed to cloth portion 100. Fasteners 104 may be any suitable type of fastening device such as velcro, snaps, buttons, etc. Velcro strips are employed in the depicted example. Other fastening arrangements, other than those requiring attachments to cloth portion 100, may also be employed as described below.

The child's pacifier also includes nipple 106. Nipple 106 may be any of a variety of commercially available non-toxic, synthetic nipples such as one of the numerous, standard-sized nipple used in connection with baby bottles. Preferably standard-sized nipples are used so that hole 102 may be sized to receive a variety of nipples, perhaps changing as the child progresses in development.

Cylindrical body 108 is an optional component which may be replaced by a variety of functionally equivalent alternatives. In the depicted embodiment, cylindrical body 108 is a slightly flexible, pliant material such as urethane or a semi-rigid foam. Cylindrical body 108 is preferably about twelve inches long and approximately 1–1½ inches in diameter. If a separate cylindrical member is utilized, nipple 106 is preferably removably affixed to the surface of the cylindrical body member at an appropriate location.

One alternative to employing a separate member is to form the cylindrical body from an extension 110 of cloth portion 100. In such an alternative, a thick, somewhat stiff material is preferred for forming cloth portion 100 and extension 110. The material used for cloth diapers has been found suitable for this purpose. Extension 110 is tightly rolled from the end opposite the location of hole 102 to form the cylindrical body. Although this alternative reduces the number of required components, use of a separate cylindrical member allows numerous cloth portions to be interchangeably used and removed for washing without significantly affecting the availability of the pacifier.

Figure 2:
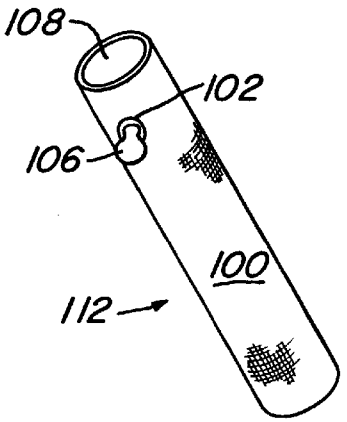
FIG. 2 is a pictorial representation of an assembled view of the components depicted in FIG. 1.

Referring now to FIG. 2, an assembled view of the components depicted in FIG. 1 are illustrated in a pictorial representation. Pacifier 112 if formed by wrapping cloth portion 100 around cylindrical body 108 and securing cloth portion 100 in place using fasteners 104. Cloth portion 100 may be secured by other means, such as externally applied tape, but with the undesirable effect of obscuring designs on cloth portion 100.

Nipple 106 is situation between cylindrical body 108 and cloth portion 100, protruding through hole 102 except for a base portion. Nipple 106 and may be held in place by cloth portion 100 if not affixed to cylindrical body 108. Nipple 106 is accessible to the child and, in the assembled pacifier 112, protrudes from a peripheral surface of the pacifier proximate to one end, within a region not longer than ¼ the total length of the pacifier. In this manner the child may easily grasp pacifier 112 while sucking on the protruding portion of nipple 106.

The elongated body of the pacifier has a length at least three times the diameter or longest cross-sectional distance of the pacifier body. The circumference of the body should not substantially exceed the circumference of a standard baby bottle. An oblong cross-section for the body portion may be advantageous for manipulation of pacifier 112 by a child, allowing the child an easier grasp.

The elongated member should be constructed of a rigid but resilient material flexible enough to allow the child to distort its shape. A tightly rolled cloth diaper has been found suitable.

Figure 3A:
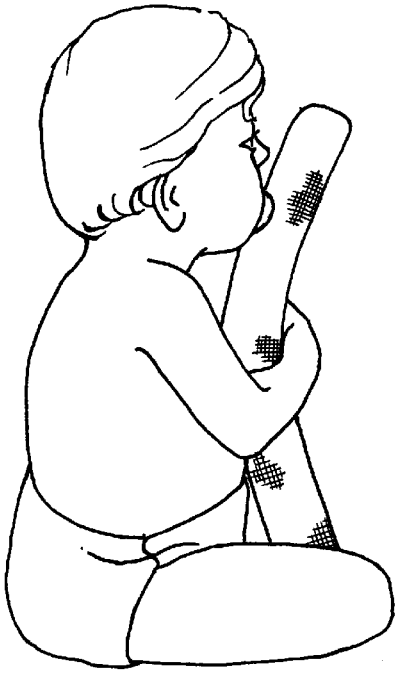
FIGS. 3A–3C depict use of a pacifier constructed in accordance with the present invention.
Figure 3B:
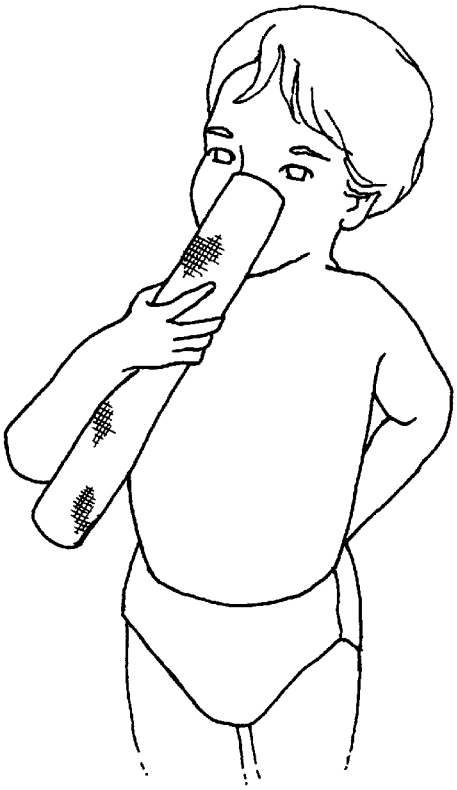
Figure 3C:
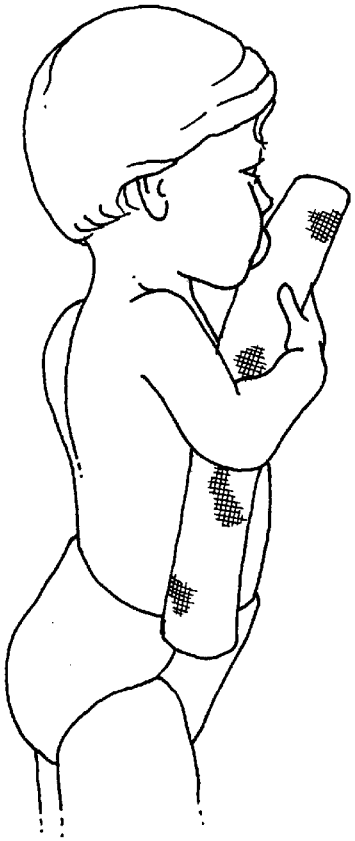

With reference now to FIGS. 3A–3C, use of a pacifier constructed in accordance with the present invention is illustrated. As can be seen from FIG. 3A, the body portion of the pacifier is sufficiently flexible to allow the child to distort its shape while using it. FIGS. 3B and 3C illustrate how easily a child may grasp and manipulate the pacifier while using it.

The pacifier of the present invention is large enough to be retrieve by children of virtually any age. Infants which have not developed sufficiently to relocate the nipple portion of the pacifier should find the soft exterior an acceptable alternative. The pacifier of the present invention promotes development of fine motor skills in children as they grasp and manipulate the pacifier while sucking the nipple or retrieving the pacifier. The overall size of the pacifier diminishes the chances of the pacifier being inadvertently lost.

The materials used for construction of the pacifier are all readily available through existing commercial sources. The exterior cloth covering may be removed and washed, with an interchangeable cloth covering taking its place in the interim. The nipple portion may be removed, replaced, or changed allowing, for example, sterilization of the nipple after the child has dropped the pacifier.

The description of the preferred embodiment of the present invention has been presented for purposes of illustration and description, but is not intended to be exhaustive or limit the invention in the form disclosed. Many modifications and variations will be apparent to those of ordinary skill in the art. The embodiment was chosen and described in order to best explain the principles of the invention and the practical application to enable others of ordinary skill in the art to understand the invention for various embodiments with various modifications as are suited to the particular use contemplated.

What is claimed is:

1. A child's pacifier, comprising:

an elongated member; and a nipple protruding from a peripheral surface of the elongate member proximate to an end, the nipple including a base portion and a nipple portion, the base portion secured between a cloth covering on the elongated member and the elongated member with the nipple portion protruding through a hole in the cloth covering.

2. The child's pacifier of claim 1, wherein the elongated member further comprises:

a flexible body; and a cloth covering wrapped around the flexible body, the cloth covering including a hole through which the nipple protrudes.

3. The child's pacifier of claim 2, wherein the nipple is removably attached to the flexible body.

4. The child's pacifier of claim 2, wherein the cloth covering is secured around the flexible body by fasteners attached to the cloth covering.

5. The child's pacifier of claim 2, wherein the flexible body has an oblong cross-section.

6. A child's pacifier, comprising:

an elongated flexible body;

a cloth covering wrapped around the flexible body, the cloth covering including a hole proximate an end of the elongated member; and a nipple including a base portion and a nipple portion, the base portion secured between the cloth covering and the elongated member and the nipple portion protruding through the hole.

7. The child's pacifier of claim 6, wherein the nipple is a standard baby bottle nipple.

8. The child's pacifier of claim 6, wherein the cloth covering is secured around the flexible body by a plurality of fasteners attached to the cloth covering.

9. The child's pacifier of claim 6, wherein the flexible body includes an oblong cross-section.

* * * * *